United States Patent [19]

Hill

[11] Patent Number: 4,610,448

[45] Date of Patent: Sep. 9, 1986

[54] HAND GRIP FOR PUSH-UPS

[76] Inventor: David L. Hill, Star Rte. South, Box 399, South Beach, Oreg. 97366

[21] Appl. No.: 574,339

[22] Filed: Jan. 27, 1984

[51] Int. Cl.[4] ..... A63B 13/00

[52] U.S. Cl. ..... 272/93; 272/143

[58] Field of Search ..... 272/93, 67, 68, 120, 272/131, 146, 143, 125, 126, 104, 63

[56] References Cited

U.S. PATENT DOCUMENTS

| | | | |
|---|---|---|---|
| 3,044,186 | 7/1962 | Berger | 272/71 |
| 3,100,639 | 8/1963 | Bonewitz | 272/146 |
| 3,115,338 | 12/1963 | Acs et al. | 272/93 |
| 4,319,749 | 3/1982 | Agyagos | 272/146 |

OTHER PUBLICATIONS

*Nautilus,* Sporting Equipment Catalogue; Jun. 14, 1979, p. 28.

*Marcy,* Sporting Equipment Catalogue; 1970; p. 8.

*Primary Examiner*—Richard J. Apley
*Assistant Examiner*—James Prizant
*Attorney, Agent, or Firm*—Chernoff, Vilhauer, McClung & Stenzel

[57] ABSTRACT

The present invention is comprised of a cylindrical handle which is mounted in a U-shaped clevis in a manner to rotate about a horizontal axis. The clevis in turn is mounted relative to the base which supports the device in a manner to rotate about a vertical axis. Thus, when being used to perform push-ups, the device allows the user to rotate his or her hand about a horizontal axis, in order to position the wrist at a comfortable position, and about a vertical axis, in order to simultaneously rotate the arm while extending or contracting it. The base is made from a high friction material to prevent the device from moving on the supporting surface while in use.

3 Claims, 4 Drawing Figures

HAND GRIP FOR PUSH-UPS

BACKGROUND OF THE INVENTION

This invention relates to hand grips for use in performing push-ups, and in particular to such hand grips where the user's hands can be rotated about either horizontal or vertical axes while performing the push-ups.

Hand grips for use in performing push-ups are well known in the prior art since they prevent the user's hands from slipping on the supporting surface and, in addition, allow the user to perform push-ups with a straight wrists rather than with his or her wrists being bent 90 degrees. Thus the wrists do not become as fatigued or subject to injury. Typical of such devices is Rozenblad, U.S. Pat. No. 4,351,525.

However, in certain athletic activities, such as pitching a curveball or placing spin on a tennis ball, it is necessary for the user to rotate his or her arm simultaneously with contraction or extension of the large arm muscles. While doing push-ups with the prior art hand grips allows the user to strengthen the large arm muscles, since the grips are immovable relative to the ground, it is not possible to rotate the arms about a vertical axis while doing the push-ups and thereby better condition the arms for use of this type. Further, due to this immovability, the user cannot rotate his or her hands about a horizontal axis to achieve more comfortable positions on the hand grips without loosening his or her grip on them.

The present invention overcomes the foregoing shortcomings and limitations of the prior art hand grips by providing a hand grip having an elongate cylindrical handle which is arranged to be gripped by the hand of the user. The handle is mounted in a clevis in a manner to be rotatable about a horizontal axis. Thus it is possible for the user to position his or her hand while doing push-ups in order to maintain the wrist in the most comfortable position. The clevis, in turn, is mounted on a base which supports the device in a manner to be rotatable about a vertical axis. Thus, the user can rotate his or her arm while performing push-ups in order to simulate the action which occurs when the arm is being used in the aforementioned manner.

The base is made from a high friction material which prevents it from sliding on the supporting surface when it is carrying the weight of the user.

Accordingly, it is a primary object of the present invention to provide a hand grip for performing push-ups having a handle which is rotatable about a horizontal axis for positioning the user's hand in a position which is comfortable for his or her wrist.

It is a further object of the present invention to provide such a hand grip which also is rotatable about a vertical axis in order that the user can rotate his or her arm while performing the push-ups.

It is a still further object of the present invention to provide such a device which is not readily movable on its supporting surface when in use.

The foregoing and other objectives, features and advantages of the present invention will more readily be understood upon consideration of the following detailed description of the invention, taken in conjunction with the accompanying drawings.

DETAILED DESCRIPTION OF THE INVENTION

Figure 1:
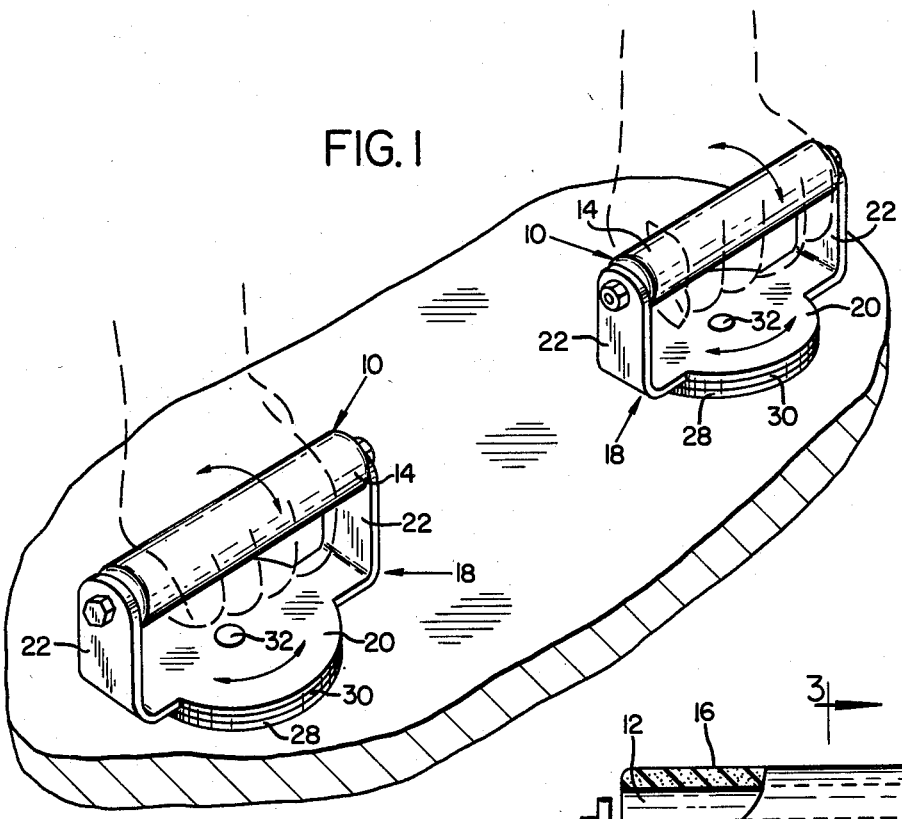
FIG. 1 is a perspective view showing two hand grips embodying the features of the present invention in use.
Figure 2:
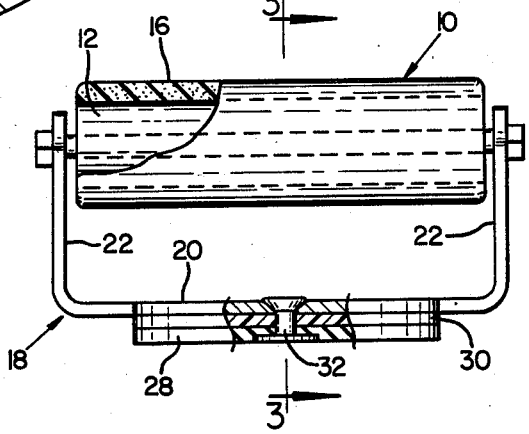
FIG. 2 is a side elevational view, partially broken away, of the hand grip of FIG. 1.
Figure 4:
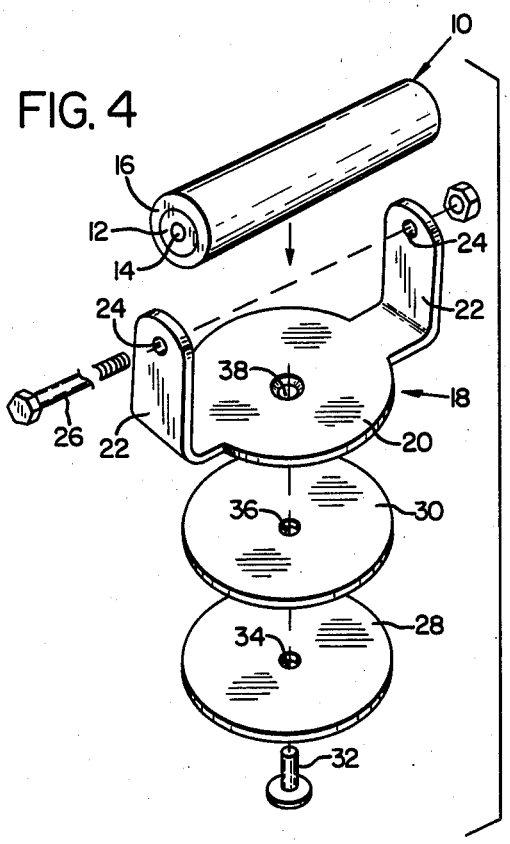
FIG. 4 is an exploded view of the hand grip.
Figure 3:
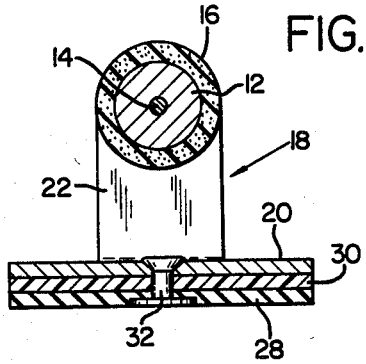
FIG. 3 is a sectional view taken along the line 3—3 of FIG. 2.

Referring to the drawings, the present invention comprises a handle 10 which, in the embodiment illustrated, comprises an elongate cylindrical tube 12. The tube is made from a relatively hard, rigid material, such as metal, wood or plastic, and has a hole 14 passing centrally through it. Extending around the outside of the tube is a cover 16, which is made from a relatively soft deformable material in order to cushion the user's hand.

The handle is rotatably mounted about a horizontal axis by means such as a U-shaped clevis 18. The clevis 18 includes a circular body 20 which has a pair of diametrically opposed ears 22 extending upwardly from it. Located near the upper extremity of the ears are openings 24 which are approximately the same size as the hole 14 in the tube 12. A bolt 26, which extends through the openings 24 and the hole 14, mounts the handle on the clevis and acts as the axis about which it rotates.

The device is supported by a base, which in the embodiment illustrated comprises a circular pad 28 which has the same diameter as the body 20 of the clevis 18. The pad is preferably made from a high friction material, such as rubber, so that it grips the surface upon which it rests. The clevis 18, and thus the handle 10, are rotatably mounted about a vertical axis relative to the base by means such as a disk 30 which fits between the body 20 and the circular pad 28. The disk 30 has the same diameter as the pad 28 and is made from a low friction material, such as teflon. The pad, disk and body are rotatably joined to one another by means such as a rivot 32 which passes through openings 34, 36 and 38, respectively.

In use, two of the hand grips are placed on a supporting surface. The user then grasps the handles as shown in FIG. 1 rather than placing his or her hands flat on the supporting surface as is normally done when performing push-ups. The non-slip surfaces of the base pads 28 keep the devices from moving relative to the supporting surface.

However, the user can rotate his or her hands about either vertical or horizontal axes if desired when performing push-ups. Rotatability about the horizontal axis is possible due to the rotation of the handle 10 about the bolt 26 which joins it to the clevis 18. Rotatability about the vertical axis is possible due to the anti-friction disk 30 which interfaces the base pad 28 and the clevis body 20.

Thus, in addition to allowing the user to perform push-ups with straight wrists, thereby preventing wrist injury, the user nonetheless can rotate his or her wrist in order to achieve a comfortable position. In addition, the hand grips of the present invention allow the user to rotate his or her arms about a vertical axis while performing push-ups thereby stretching and conditioning the muscles which provide the rotary movement in addition to strengthening the arm and shoulder muscles in the manner normally achieved by performing push-ups. As a result, the push-ups have a greater effect when a person will be doing something where his or her arm makes a rotary motion simultaneously with being extended or contracted, such as throwing a curve ball or in placing spin on a tennis ball.

The terms and expressions which have been employed in the foregoing description are used therein as terms of description and not of limitation, and there is no intention in the use of such terms and expressions of excluding equivalents of the features shown and described or portions thereof, it being recognized that the scope of the invention is defined and limited only by the claims which follow.

What is claimed is:

1. A method for doing push-ups comprising:

(a) providing a pair of spaced apart hand grips each having a handle and a base for supporting them on an underlying surface, said handle being rotatable relative to said base about vertical axes;

(b) supporting one's body in a prone position above said underlying surfaces by gripping said handles; and (c) performing push-ups while simultaneously rotating said handles about said vertical axes.

2. The method of claim 1 wherein said handles have gripping portions which are also rotatable relative to said base about horizontal axes, including the step of rotating said handles about said horizontal axes to position one's wrists in comfortable orientations prior to starting to perform the push-ups.

3. The method of claim 2 including the further step of rotating said handles about said horizontal axes while performing the push-ups to maintain one's wrists in comfortable orientations.

* * * * *